United States Patent [19]

Locker

[11] 4,183,756

[45] Jan. 15, 1980

[54] PRE-PRECIPITATION SPECTRAL SENSITIZING DYE ADDITION PROCESS

[75] Inventor: David J. Locker, Rochester, N.Y.

[73] Assignee: Eastman Kodak Company, Rochester, N.Y.

[21] Appl. No.: 944,666

[22] Filed: Sep. 22, 1978

Related U.S. Application Data

[63] Continuation-in-part of Ser. No. 902,451, May 3, 1978, abandoned.

[51] Int. Cl.[2] ..... G03C 1/10; G03C 1/02

[52] U.S. Cl. ..... 430/569; 430/581

[58] Field of Search ..... 96/94 R, 120, 121, 130, 96/108

[56] References Cited

U.S. PATENT DOCUMENTS

| | | | |
|---|---|---|---|
| 2,735,766 | 2/1956 | Hill | 96/121 |
| 3,628,960 | 12/1971 | Philippaerts et al. | 96/94 R |
| 3,883,355 | 5/1975 | Walworth | 96/94 R |
| 4,060,419 | 11/1977 | Gerber et al. | 96/94 R |

OTHER PUBLICATIONS

Reinders, "Studies of Photohalide Crystals", Kolloid-Zeitschrift, vol. 9, pp. 10–14, 1911.

*Primary Examiner*—J. Travis Brown
*Attorney, Agent, or Firm*—Carl O. Thomas

[57] ABSTRACT

A method of preparing a spectrally sensitized radiation-sensitive silver halide emulsion is disclosed in which a methine spectral sensitizing dye is added to a reaction vessel prior to the concurrent introduction of aqueous halide and silver salt solutions. The silver halide grains concurrently formed and spectrally sensitized in this manner exhibit relatively high minus blue speeds.

16 Claims, No Drawings

PRE-PRECIPITATION SPECTRAL SENSITIZING DYE ADDITION PROCESS

CROSS-REFERENCE TO RELATED APPLICATION(S)

This is a continuation-in-part of my copending patent application Ser. No. 902,451, filed May 3, 1978 now abandoned.

This disclosure is directed to a process of preparing spectrally sensitized silver halide grains by the addition of a methine spectral sensitizing dye to a reaction vessel in which the silver halide grains are formed.

In spectrally sensitizing silver halide emulsions it is conventional practice to adsorb the spectral sensitizing dyes to the surfaces of the silver halide grains after they have been completely formed. However, there are some variant teachings in the art.

Hill U.S. Pat. No. 2,735,766, issued Feb. 21, 1956, discloses that photographic spectral sensitizing dye wandering can be eliminated or reduced by introducing a merocyanine spectral sensitizing dye during silver halide precipitation. Hill teaches to blend the spectral sensitizing dye with either the silver salt or the halide salt prior to bringing these salts together to form silver halide. Hill specifically states that the teachings do not extend to other optical sensitizing dyes, such as those of the carbocyanine class.

Philippaerts U.S. Pat. No. 3,628,960, issued Dec. 21, 1971, in discussing methine dye spectral sensitization of a blended emulsion states that the dyes can be incorporated in a separate addition or can be added as a mixture with one or more ingredients used in the formation of the different silver halide grains, during physical or chemical ripening or during another step preceding the coating of the emulsion.

D. J. Locker and R. L. Daubenidek in U.S. Ser. No. 881,230, filed Feb. 27, 1978, (now refiled as U.S. Ser. No. 8,911 on Feb. 2, 1979), titled SILVER HALIDE PRECIPITATION AND METHINE DYE SPECTRAL SENSITIZATION PROCESS AND PRODUCTS THEREOF disclose that by spectrally sensitizing a silver halide emulsion with a methine dye prior to complete formation of the silver halide grains, as is conventional practice, one or more of the following advantages can be obtained: (1) improved photographic speeds, particularly minus blue speeds; (2) better shelf life stability; (3) substantial elimination of dye desorption and staining; (4) altered dye absorption characteristics; and/or (5) control or modification of the silver halide grain crystal habit. Locker and Daubendiek demonstrate that delaying introduction of the spectral sensitizing dye to the reaction vessel until after silver halide nuclei are present results in significantly improved minus blue speeds as compared with adding the dye to the reaction vessel with one of the aqueous silver and halide salt solutions, as taught by Hill and Philippaerts.

In one aspect, this invention is directed to a method of preparing a spectrally sensitized radiation-sensitive silver halide emulsion by a double jet precipitation process in which an aqueous halide salt and an aqueous silver salt are concurrently run into a reaction vessel. The halide salt is at least 50 mole percent chloride. The method comprises introducing into the reaction vessel an aqueous dispersing medium, introducing into the dispersing medium a minor portion of one of the aqueous halide salt and the aqueous silver salt, and thereafter concurrently introducing into the pAg adjusted dispersing medium in the presence of a peptizer the remainder of the aqueous halide and silver salt solutions. In this method the improvement comprises introducing a methine dye into the reaction vessel in a spectrally sensitizing amount prior to concurrent introduction of the aqueous halide and silver salt solutions.

The present invention offers advantages similar to those disclosed by Locker and Daubendiek over spectral sensitization of a silver halide emulsion after the silver halide grains have been completely formed. It is surprising that introducing a methine spectral sensitizing dye into a reaction vessel prior to the addition of the aqueous halide and silver salts offers speed advantages over the concurrent addition of dye and aqueous salts, as taught by Hill and Philippaerts. This is even more surprising in view of the disclosure of Locker and Daubendiek that improved speeds, particularly minus blue speeds, can be obtained by delaying introduction of the spectral sensitizing dye into the reaction vessel until after silver halide nuclei are present.

This method is applicable to any conventional method of forming radiation-sensitive silver halide grains in which an aqueous solution of a silver salt and one or more halide salt solutions which are at least 50 mole percent chloride, preferably at least 80 mole percent chloride, based on total halide, are concurrently brought into a reaction vessel to form radiation-sensitive silver halide grains. This method is particularly applicable to the spectral sensitization of radiation-sensitive silver chloride and silver chlorohalides which are at least 50 mole percent silver chloride, based on total halide, such as silver chlorobromide, silver chloroiodide and silver chlorobromoiodide. It is generally preferred that the silver iodide containing silver chlorohalides contain less than about 10 mole percent iodide, based on total halide.

The method of this invention for preparing and concurrently spectrally sensitizing silver halide emulsions can be practiced by modifying, in the manner described below, conventional procedures for double jet preparation of silver halide emulsions. In double jet precipitations a silver salt, such as silver nitrate, and a halide salt, such as an alkali halide (e.g., sodium or potassium halide), each in the form of an aqueous salt solution, are concurrently and separately introduced into the reaction vessel. All illustrative conventional double jet silver halide precipitation technique is that disclosed by Nietz and Russell U.S. Pat. No. 2,222,264, issued Nov. 19, 1940, or Illingsworth U.S. Pat. No. 3,655,394, issued Apr. 11, 1972. Double jet silver halide emulsion precipitation methods are also discussed in Chapters 1 and 2 of Mees and James, *The Theory of the Photographic Process*, Third Edition, the MacMillan Company, 1966.

In accordance with conventional practice, an aqueous dispersing medium is present in the reaction vessel prior to the introduction of the aqueous halide and silver salt solutions. The presence of the dispersing medium along with agitation, in most instances, facilitates uniform blending of the aqueous halide and silver salt solutions while avoiding localized concentration gradients. Typically a dispersing medium volume is initially present in the reactio vessel which is from about 10 to 90 percent, preferably 20 to 80 percent, that of the silver halide emulsion to be formed.

The dispersing medium is conventionally water or a dispersion of peptizer in water, optionally containing other ingredients, such as one or more silver halide ripening agents, more specifically described below. Prior to introducing the aqueous silver and halide salts into the reaction vessel a conventional methine spectral sensitizing dye is introduced into the dispersing medium in an amount sufficient to spectrally sensitize the silver halide emulsion to be formed. The methine dye can be added to the dispersing medium using the conventional techniques for adding spectral sensitizing dyes to silver halide emulsions, as illustrated by Paragraph XVII, *Product Licensing Index,* Vol. 92, December 1971, publication 9232. Where the spectral sensitizing dye is itself water soluble, it can be introduced without any additional or auxiliary solvent.

Exemplary of the conventional methine spectral sensitizing dyes that can be introduced into the dispersing medium in the reaction vessel prior to silver halide precipitation are those described in Brooker et al U.S. Pat. No. 2,526,632 issued Oct. 24, 1950; Sprague U.S. Pat. No. 2,503,776 issued Apr. 11, 1950; Brooker et al U.S. Pat. No. 2,493,748 issued Jan. 10, 1950; and Taber et al U.S. Pat. No. 3,384,486 issued May 21, 1968. Spectral sensitizers which can be used include the cyanines, merocyanines, complex (tri- or tetra-nuclear) cyanines, holopolar cyanines, styryls, hemicyanines (e.g. enamine hemicyanines), oxonols and hemioxonols.

Dyes of the cyanine classes suitable for sensitizing silver halide can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl and enamine groups and acn be fused to carbocyclic or heterocyclic ring systems either unsubstituted or substituted with halogen, phenyl, alkyl, haloalkyl, cyano, or alkoxy groups. The dyes can be symmetrical or unsymmetrical and can contain alkyl, phenyl, enamine or heterocyclic substituents on the methine or polymethine chain.

The merocyanine dyes can contain the basic nuclei mentioned above as well as acid nuclei such as thiohydantions, rhodanines, oxazolidenediones, thiazolideneiones, barbituric acids, thiazolineones, and malononitrile. These acid nuclei can be appropriately substituted with alkyl, alkylene, phenyl, carboxyalkyl, sulfoalkyl, hydroxyalkyl, alkoxyalkyl, alkylamino groups, or heterocyclic nuclei. Combinations of these dyes can be used, if desired. In addition, supersensitizing addenda which do not absorb visible light can be included, for instance, ascorbic acid derivatives, azaindenes, cadmium salts, and organic sulfonic acids as described in McFall et al U.S. Pat. No. 2,933,390 issued Apr. 19, 1960; and Jones et al U.S. Pat. No. 2,937,089 issued May 17, 1960.

The cyanine methine dyes employed in the practice of this invention are in one preferred form imidazole, oxazole and thiazole methine spectral sensitizing dyes. That is, they are conventional methine spectral sensitizing dyes containing at least one imidazole, oxazole or thiazole nucleus. In a specifically preferred form, the spectral sensitizing dyes are cyanine dyes in which at least two nuclei of the dye are chosen from imidazole, oxazole and thiazole nuclei. Specifically preferred are cyanine dyes in which both of the nuclei are imidazole, oxazole or thiazole nuclei, such as those represented by the formula:

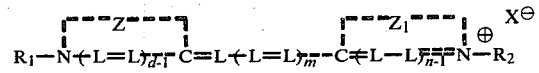

wherein d and n each represents a positive integer of from 1 to 2, m represents a positive integer of from 1 to 3, L represents a methine group (e.g., —CH= and —C(CH$_3$)=), $R_1$ and $R_2$ each represents an alkyl group, preferably a lower alkyl containing from one to four carbon atoms, (e.g., methyl, ethyl, propyl, isopropyl, butyl, hexyl, decyl or dodecyl), a substituted alkyl group, preferably a substituted lower alkyl group containing one to four carbon atoms, such as a hydroxyalkyl group (e.g., β-hydroxyethyl, γ-hydroxypropyl or ω-hydroxybutyl), an alkoxyalkyl group (e.g., β-methoxyethyl or β-butoxybutyl), a carboxyalkyl group (e.g., β-carboxyethyl or ω-carboxybutyl), a sulfoalkyl group (e.g., β-sulfatoethyl or ω-sulfatobutyl), an acyloxyalkyl group (e.g., β-acetoxyethyl or ω-propionyloxybutyl), an alkoxycarbonylalkyl group (e.g., β-methoxycarbonylethyl or ω-ethoxycarbonylbutyl), an allyl group, an aralkyl group (e.g., benzyl or phenethyl) or an aryl group (e.g., phenyl, tolyl, chlorophenyl, sulfophenyl or carboxyphenyl), and Z and $Z_1$ each represents an imidazole nucleus (e.g., imidazole, alkyl imidazoles, 1-aryl imidazoles, benzimidazole, 1-alkyl benzimidazoles, 1-aryl benzimidazoles, 5-chloro-1-alkyl benzimidazoles, 5-chloro-1-aryl benzimidazoles, 5,6-dichloro-1-alkyl benzimidazoles, 5,6-dichloro-1-aryl benzimidazoles, 5-methoxy-1-alkyl benzimidazoles, 5-methoxy-1-aryl benzimidazoles, 5-cyano-1-alkyl benzimidazoles, 5-cyano-1-aryl benzimidazoles, naphth[1,2-d]imidazole, 1-alkylnaphth[1,2-d]imidazoles or 1-arylnaphth[1,2-d]imidazoles), an oxazole nucleus (e.g., oxazole, 4-alkyl oxazoles, 4,5-dialkyl oxazoles, 4-aryl oxazoles, 4,5-diaryl oxazoles, 4-nitrooxazole, benzoxazole, 5-chlorobenzoxazole, 5- or 6-nitrobenzoxazole, 5-arylbenzooxazole, 5- or 6-alkoxy benzoxazole, 5- or 6-hydroxy benzooxazole, naphtho[1,2-d]oxazole or nitro-substituted naphth[1,2-d]oxazoles) or a thiazole nucleus (e.g., thiazole, 4-alkyl thiazoles, 2-thienyl thiazoles, 4-aryl thiazoles, 4,5-diaryl thiazoles, benzothiazole, 5- or 6-chloro or bromobenzothiazoles, 4-alkyl benzothiazoles, 5- or 6-alkoxy benzothiazoles or 4-aryl benzothiazoles).

It will be noted that in some instances, the acid anion, represented by X in the above formula, is included in the substituent represented by $R_2$, such as in dyes containing the betaine type structure. In the nuclei substituents referred to above the alkyl moieties preferably contain from 1 to 4 carbon atoms and the aryl substituents contains from 6 to 10 carbon atoms, e.g., phenyl and naphthyl. Imidazole, oxazole and thiazole cyanine spectral sensitizing dyes are well known in the art and are disclosed, for example, by A. H. Herz, Photographic Science and Engineering, vol. 18, No. 2, March–April 1974, pages 207 through 215; VanLare, U.S. Pat. No. 3,482,981, issued Dec. 9, 1962; and in numerous other patents and publications.

Illustrative of preferred merocyanine spectral sensitizing dyes are those disclosed by Hill U.S. Pat. No. 2,735,766.

To facilitate dispersing or dissolving the dye in the dispersing medium the dye can be conveniently first dispersed or dissolved in a relatively small liquid volume before introduction into the dispersing medium. The separate liquid to which the dye is added before addition to the dispersing medium is typically less than about 10 percent by volume of the dispersing medium volume after dye addition and before silver or halide salt additions. A water-miscible organic solvent for the dye can be employed alone or in combination with water, particularly where the dye is not itself directly soluble water. The water-miscible organic solvents employed can be chosen from among a variety of useful organic liquids, such as water-miscible alcohols, ketones and amides (e.g., acetone, ethyl alcohol, methyl alcohol, isopropyl alcohol, dimethylformamide and methyl ethyl ketone), tetrahydrofuran, N-methyl-2-pyrrolidone, dimethyl sulfoxide and mixtures thereof.

Conventional procedures and apparatus for mixing the spectral sensitizing dyes with the dispersing media can be employed. Ultrasound can be employed to dissolve the dyes in the dispersing media, as illustrated by Owen et al U.S. Pat. No. 3,485,634. Other apparatus and procedures are illustrated by Johnson et al U.S. Pat. Nos. 3,425.835, 3,570,818, 3,773,302 and 3,850,643; McCrossen et al U.S. Pat. No. 3,342,605; Collins et al U.S. Pat. No. 3,912,343 and Terwilliger et al U.S. Pat. Nos. 3,827,888 and 3,888,465.

The spectral sensitizing dye can be added to the dispersing medium in any concentration which will spectrally sensitize the silver halide emulsion to be formed. Generally the optimum concentration of the spectral sensitizing dye is a function of the silver halide grain surface on which it is adsorbed in the finished emulsion. For example, efficient spectral sensitization can be achieved when sufficient dye is present in the dispersing medium to provide a monolayer coverage of at least about half of the surface area of the silver halide grains to be formed, assuming uniform surface adsorption, to about twice the amount of spectral sensitizing dye required to provide such monolayer coverage. Since the surface areas of the silver halide grains vary as a function of their mean size and their crystal habit, the quantities of the spectral sensitizing dyes required to provide monolayer coverages also vary. However, spectral sensitizing dye concentrations in the range of from about 0.01 to 2 grams, preferably 0.1 to 1 gram, per mole of silver halide, based on the weight of silver, are commonly employed in silver halide spectral sensitization and are specifically contemplated.

The initially formed silver halide grains (i.e., silver halide nuclei) are sufficiently small that they can be dispersed by water alone. Thus, it is unnecessary to have any peptizer initially in the reaction vessel, although it is frequently convenient to have the peptizer at least partially present in the reaction vessel prior to initiating introduction of the silver and halide salts. Peptizer can be added to the reaction vessel with the halide salt, the silver salt or both and/or independently of both. While peptizer concentrations from 0.2 to about 10 percent by weight, based on the total liquid or emulsion weight in the reaction vessel, can be employed, it is preferred to keep the concentration of the peptizer in the reaction vessel prior to and during silver halide formation below about 6 percent by weight, based on the total weight. It is common practice to maintain the concentration of the peptizer in the reaction vessel in the range of from about 2 6 percent, based on the total weight, prior to and during silver halide formation and to adjust the concentration of the peptizer upwardly for optimum coating characteristics by delayed, supplemental peptizer additions.

Any conventional silver halide peptizer can be employed in the practice of this process. A variety of conventional silver halide peptizers are disclosed, for example, in *Product Licensing Index*, Vol. 92, December 1971, publication 9232, paragraph VIII. Hydrophilic colloid peptizers are preferred, particularly gelatin—e.g., alkali-treated gelatin (cattle bone or hide gelatin) or acid-treated gelatin (pigskin gelatin) and hardenable gelatin derivatives, such as those illustrated by Yamamoto et al U.S. Pat. No. 3,923,517, particularly gelatin derivatives produced by reacting carboxylic acid anhydrides or halides with gelatin (e.g., acetylated gelatin, phthalated gelatin and the like) as further illustrated by Barnes et al U.S. Pat. No. 3,545,971. Exemplary of other preferred polymeric materials which can be used in place of gelatin and gelatin derivatives are materials such as poly(vinyl alcohol), poly(vinylpyrrolidone), polyacrylamides and the copolymers described in U.S. Pat. Nos. 3,692,753 and 3,813,251.

Although not required for the practice of this process, it is preferred that a silver halide ripening agent be present within the reaction vessel during silver halide formation. The ripening agent can be entirely contained within the dispersing medium in the reaction vessel before silver and halide salt addition, or it can be introduced into the reaction vessel along with one or more of the halide salt, silver salt or peptizer. In still another variant the ripening agent can be introduced independently during halide and silver salt additions.

Sulfur containing ripening agents are generally preferred. Conventional thioether ripening agents, such as those disclosed in MacBride U.S. Pat. No. 3,271,157, here incorporated by reference, can be employed. Sufficient thioether ripening agent is employed to provide concentrations of from 0.05 to 50 grams, preferably about 0.1 to 20 grams, per mole of silver halide, based on the weight of silver.

Certain of the preferred organic thioether silver halide solvents can be represented by the formulas:

$Q\text{-}[(CH_2)_r\text{-}CH_2\text{-}S\text{-}(CH_2)_2\text{-}X\text{-}(R)_p\text{-}(CH_2)_2\text{-}(R')_q\text{-}S\text{-}CH_2(CH_2)_m\text{-}Z]_n$ and $Q\text{-}(CH_2)_m\text{-}(CH_2\text{-}S\text{-}(CH_2)_n\text{-}S\text{-}CH_2(CH_2)_r\text{-}Z$ wherein: r and m are integers of 0 to 4; n is an integer of 1 to 4; p and q are integers of 0 to 3; X is an oxygen atom (——), a sulfur atom (—S—), a carbamyl radical ($-\overset{O}{\overset{\|}{C}}NH-$), a carbonyl radical ($-\overset{O}{\overset{\|}{C}}-$) or a carboxy radical ($-\overset{O}{\overset{\|}{C}}OH$);

R and R′ are ethylene oxide radicals ($-O-CH_2CH_2-$); Q and Z are hydroxy radicals (—OH), carboxy radicals, or alkoxy radicals (—O—alkyl) wherein the alkyl group has 1 to 5 carbon atoms; and Q and Z can also be substituents described for X linked to form a cyclic compound.

Preferred organic thioether silver halide ripening agents suitable for forming the emulsions of the invention include compounds represented by the formulas:

$$HO(-R^2-S-)_rR^2OH,$$
$$(HO-R^2-S-R^2-O-R^4)_2,$$
$$R^3-O-R^2-S-R^2-\overset{\overset{\displaystyle O}{\|}}{C}NH-R^4-)_2,$$
$$(R^3-O-R^2-S-R^2-)_2S,$$
$$(R^3-NH\overset{\overset{\displaystyle O}{\|}}{C}-R^2-S-R^2-)_2O \text{ and}$$

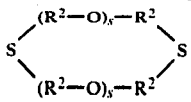

wherein: r is an integer of 1 to 3; is an integer of 1 to 2; $R^2$ is an alkylene radical having 1 to 5 carbon atoms and is preferably ethylene ($-CH_2CH_2-$); $R^3$ is an alkyl radical having 1 to 5 carbon atoms and is preferably ethyl; and $R^4$ is an alkylene radical having 1 to 5 carbon atoms and is preferably methylene ($-CH_2-$).

As an alternative to thioether ripening agents, thiocyanate salts can be used, such as alkali metal, most commonly potassium, and ammonium thiocyanate salts. While any conventional quantity of the thiocyanate salts can be introduced, preferred concentrations are generally from about 0.1 to 20 grams of thiocyanate salt per mole of silver halide in the emulsion being withdrawn from the reaction chamber. Illustrative prior teachings of employing thiocyanate ripening agents are found in Nietz and Russell, U.S. Pat. No. 2,222,264, cited above; Lowe et al U.S. Pat. No. 2,448,534, issued Sept. 7, 1948; and Illingsworth U.S. Pat. No. 3,320,069, issued May 16, 1967, the disclosures of which are here incorporated by reference.

Prior to concurrently introducing the aqueous silver and halide salt solutions into the reaction vessel, a minor portion, typically less than 20 percent, of one of the aqueous silver and halide salt solutions is run into the reaction vessel. This facilitates maintenance of the desired pAg within the reaction vessel during silver halide precipitation. It is generally preferred that a minor portion of the aqueous halide salt solution be added to the dispersing medium, since silver halide precipitation is generally carried out at a pAg on the halide ion side of the equivalence point. While silver halide precipitation on both the halide ion and silver ion sides of the equivalence point is known to the art, it is conventional to avoid precipitation at or very near the equivalence point, since accurate control of the pAg in this region during precipitation has been found difficult.

As is well understood within the art, pAg is the negative logarithm (hereinafter designated log) of the silver ion concentration expressed in normality units (which for monovalent ions corresponds to moles/liter). By regulating the pAg within the reaction chamber the relative concentration of halide ion is also regulated. Where a silver salt and a bromide salt, for example, are being introduced concurrently into the reaction chamber at a given temperature, the relationship of the silver and bromide ion concentrations can be expressed by the following equation:

$$\log Ksp = pBr + pAg$$

where pAg is the negative log silver ion concentration, expressed in normality units, pBr is the negative log bromide ion concentration, expressed in normality units, and Ksp is the solubility product constant at the temperature of reaction. The equivalence point is exactly one-half the Ksp for a specific silver halide. The equivalence point represents the point at which a stoichiometric ratio of silver ion to halide ion exists within the reaction medium. The equivalence point for a given silver halide is a function of the specific halide ion and ambient temperature. Techniques for monitoring and regulating pAg during silver halide precipitation are disclosed, for example, by Culhane et al U.S. Pat. No. 3,821,002, issued June 28, 1974, and by Claes and Peelaers, *Photographische Korrespondenz*, 103, 161 (1967).

During the initial introduction of the aqueous silver and halide salt solutions into the reaction vessel the dissolved silver salt reacts with dissolved halide salt to form silver halide crystals. This initial phase of silver halide emulsion preparation in which new silver halide crystals are being formed is referred to as nucleation. During subsequent addition of silver and halide salts, additional silver halide formed as a reaction product can be precipitated onto these nuclei, causing the mean size of the silver halide to increase and ultimately resulting in silver halide grains of the desired mean particle size.

Although additional silver halide grain formation can occur after the initial formation of silver halide nuclei, techniques are known in the art for favoring continued silver halide precipitation onto the originally formed silver halide nuclei. This has the effect of producing a population of silver halide grains of similar size—i.e., monodispersed silver halide emulsions. One technique which is commonly employed for insuring that additional silver halide precipitates onto existing silver halide nuclei is either stepwise or gradually to increase the rates of halide and silver salt additions. Such techniques are well known in the art and are disclosed, for example, by Kurz U.S. Pat. No. 3,672,900, issued June 27, 1972. However, in practicing the present process it has been found that these techniques do not result in the formation of monodispersed silver halide emulsions. Rather, polydispersed emulsions are obtained. That is, a relatively wide size distribution of silver halide grains is produced. This is believed to be the result of additional silver halide nucleation taking place after initial nucleation so that silver halide grains are being newly formed while the originally formed silver halide nuclei are being grown. The presence of the spectral sensitizing dye in the reaction vessel is believed to account for the formation of polydispersed silver halide emulsions under conditions which normally produce monodispersed emulsions. It is, of course, recognized that other precipitation conditions can be varied to favor the formation of polydispersed emulsions in accordance with conventional emulsion making procedures.

The reaction vessels as well as the apparatus and techniques for associating the aqueous silver and halide salt solutions and handling the silver halide emulsion which is formed as a reaction product can be of any convenient conventional type. Such apparatus and techniques are illustrated by Hill, Philippaerts, and *Product Licensing Index* publication 9232, paragraph XVII, each cited above. Such techniques and apparatus are further illustrated by Culhane et al U.S. Pat. No. 3,821,002; British Pat. No. 1,302,405; Irie et al U.S. Pat. No. 3,650,757; Audran U.S. Pat. No. 2,996,287; British Pat. No. 846,190; Frame et al U.S. Pat. No. 3,415,650; Porter et al U.S. Pat. No. 3,785,777; Porter et al U.S. Pat No.

3,782,954; West German OLS 2,555,364; West German OLS No. 2,555,885; Posse et al U.S. Pat. No. 3,790,386; and Forster et al U.S. Pat. No. 3,897,935.

By employing a double jet precipitation technique as described above modified by the introduction of a methine spectral sensitizing dye into the reaction vessel before silver halide formation has commenced, a polydispersed silver halide emulsion can be prepared having unique properties. Such an emulsion when coated onto a conventional photographic film or paper support to form a photographic element exhibits a unique spectral response which distinguishes it from otherwise identically formed photographic elements in which the spectral sensitizing dye is added to the emulsion after completion of the silver halide precipitation. Additional preferred and unexpected characteristics can be imparted to the photographic silver halide emulsions and elements by employing in combination materials and procedures more specifically discussed below.

It is specifically contemplated that this process can be practiced in combination with other techniques for spectral sensitization. For example, in addition to providing a spectrally sensitizing amount of methine dye in the dispersing medium of the reaction vessel prior to halide and silver salt additions, it is contemplated to also add spectral sensitizing dye to the completed silver halide emulsion. It is also contemplated that a spectrally sensitizing amount of the methine dye can be added to the dispersing medium prior to halide and silver salt additions and that additional amounts of spectral sensitizing dye can also be added during silver halide precipitation according to the teachings of Locker and Daubendiek, cited above. Enhanced spectral sensitization can be achieved by employing these combined techniques.

Photographic compositions and elements including silver halide grains spectrally sensitized as described above can include a number of compatible, conventional features not specifically described. Such conventional aspects of the composition and element types and processes for their preparation and use are disclosed in *Product Licensing Index*, Vol. 92, December 1971, publication 9232, pages 107–110, here incorporated by reference. The silver halide emulsions can be either unwashed or washed as disclosed by paragraph II. Emulsion washing. The emulsions can be chemically sensitized as disclosed by paragraph III. Chemical sensitizing. The emulsions can contain development modifiers, antifoggants and stabilizers, developing agents and hardeners, as disclosed in paragraphs IV through VII. Any of the conventional vehicles for the emulsions disclosed in paragraph VIII can be employed. The emulsions and other element layers can be coated on photographic supports as disclosed in paragraph X. Supports. Any conventional spectral sensitizing dye can be incorporated into the emulsion in addition to the spectral sensitizing dyes added during silver halide precipitation. Typical conventional dyes are disclosed in paragraph XV. Spectral sensitization. These additional spectral sensitizing dyes as well as other addenda can be introduced into the emulsion compositions by the techniques disclosed, for example, in paragraph XVII. Methods of addition. The remaining paragraphs of the *Product Licensing Index* publication disclose still other photographic features and methods of photographic processing which can be employed in combination with the features of this invention specifically disclosed. *Product Licensing Index is published by Industrial Opportunities Limited, Homewell, Havant Hampshire, P09 1EF, United Kingdom.*

The invention is further illustrated by the following examples:

Example 1 - Illustrating Spectral Sensitization of a Silver Chloride with a Benzothiazole Merocyanine The following solutions were employed:

| | |
|---|---|
| Solution A | |
| Phthalated gelatin | 240 g |
| 1,8-Dihydroxy-3,6-dithiaoctane | 2.1 g |
| 21.9% by weight sodium chloride in water | 246 ml |
| Distilled water | 8400 ml |
| Solution B | |
| Sodium chloride | 520 g |
| Distilled water to total volume of | 3460 ml |
| Solution C | |
| Silver nitrate | 1020 g |
| Distilled water to total volume of | 3460 ml |
| Solution D | |
| Dye I* | 0.78 g |
| 1:1, volume ratio, acetone to water | 500 ml |
| Distilled water | 127 ml |

*Dye I
5-(3-Ethyl-2-benzothiazolidinylidene)-3-β-sulfoethylrhodanine

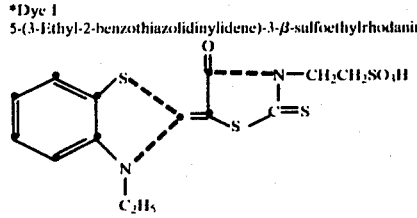

Solutions A and D were placed in a reaction vessel equipped with a mechanical stirrer and adjusted to a ph of 5.6 and pAg of 6.7 at 60° C. to form a dispersing medium. While agitating the dispersing medium, Solutions B and C were separately introduced into the reaction vessel in separate jets at a uniform rate over a period of 40 minutes while maintaining the pAg of the composition within the reaction vessel at 6.7.

The emulsion produced was coagulated by lowering the pH and the supernatant liquid was decanted. After decanting the supernatant liquid, the coagulum was redispersed in water. This procedure was repeated twice. The final coagulum was dispersed in water at 40° C./pH 5.6/pAg 7.6. Electron micrographs showed that the silver halide grains were predominantly octahedral.

The emulsion was chemically sensitized with gold sulfide, combined with a cyan dye-forming coupler, 1-hydroxy-2-[Δ-(2,4-di-t-amylphenoxy)-n-butyl]naphthamide, and coated on a cellulose acetate film support at 1.62 g Ag/m$^2$, 7.0 g gelatin/m$^2$ and 1.78 g coupler/m$^2$.

The dried coating was exposed for 1/25 second to tungsten light which was filtered to provide a 470 nm exposure and processed for 60 seconds/31° C. in the color developer set forth in Table I.

Table I

| Color Developer | |
|---|---|
| 4-amino-3-methyl-N-ethyl-N-β-(methanesulfonamido)ethylaniline sulfate hydrate | 4.3 g |
| Potassium bromide | 0.15 g |
| Potassium chloride | 1.0 g |
| Benzyl alcohol | 11.0 g |

Table I-continued

| Color Developer | |
|---|---|
| Hydroxylamine sulfate | 3.4 g |
| Potassium carbonate | 31.0 g |
| Potassium bicarbonate | 0.5 g |
| Potassium sulfite | 2.0 g |
| Hydroxyethylcellulose (Natrosol 250L ®) | 0.06 g |
| Water to 1 liter, pH 10.08 | |

The silver chloride emulsion ws polydispersed with mean grain diameters falling in the range of from 0.45 to 1.3 micron. The contrast of the emulsion was 1.58, the minimum density 0.10 and the maximum density 1.80. For purposes of comparison with the remaining examples, a relative speed value of 73 was assigned to the emulsion. The monodispersed emulsion of Locker and Daubendiek, cited above, Example 1, was assigned a relative speed value of 100. Speed was measured at 0.30 above minimum density on the characteristic curve.

Comparative Emulsion Investigations

The procedure of Example 1 was repeated, except that Solution D was not initially added to Solution A, addition of Solutions B and C were halted 30 minutes after the beginning of the precipitation step, and Solution D was then added to the reaction vessel over a period of 5 minutes. After Solution D's addition was complete, Solutions B and C were added to the reaction vessel to complete precipitation of silver halide.

The silver halide emulsion produced was polydispersed with mean grain diameters falling within the range of from 0.45 to 0.95 micron. The contrast of the emulsion was 2.16, the minimum density 0.10 and the maximum density 2.00. The relative speed, compared to Example 1, was 46. This comparative emulsion is that of Example 2 of Locker and Daubendiek, cited above.

In a separate run, when the introduction of Solution D was delayed until after Solutions B and C had been run for 35 minutes, the resulting emulsion exhibited comparable minimum and maximum densities, but a somewhat lower speed and contrast, than the immediately preceding comparative emulsion.

To provide a direct comparison with conventional precipitation techniques, the procedure of Example 1 was repeated, except that Dye I was not present during the precipitation step. Dye I was added just prior to coating the emulsion on the support at a coverage of 130 mg/mole Ag.

The emulsion was monodispersed having a mean grain diameter of 0.70 micron. The silver chloride grains were cubic. The contrast was 2.20, the minimum density 0.10 and the maximum density 2.00. The relative speed, compared to Example 1, was 25.

When the elements produced by Example 1 and by conventional dye addition just prior to coating were separately immersed in an agitated 1:1 (weight ratio) methanol-water solution, it was observed that spectral sensitizing dye entered the solution from the conventional element. No spectral sensitizing dye was removed from the element of Example 1. This showed the dye in the Example 1 element to be so tightly held as to be non-wandering. It is not understood exactly how the spectral sensitizing dye present during silver halide precipitation is associated with the silver halide grains, but it appears that the relationship of the dye to the grains produced by this method is demonstratably different than that produced by introducing the spectral sensitizing dye after silver halide precipitation.

The concept of introducing the spectral sensitizing dye into the reaction vessel along with one of the silver or halide salts before silver halide nucleation is known in the art, as illustrated by the teachings of Hill and Philippaerts, cited above. When Example 1 was repeated with Dye I incorporated in the aqueous halide salt solution, Solution B, a markedly inferior, polydispersed silver halide emulsion was obtained. The relative speed of the emulsion, compared with Example 1, was only 1. When the procedure was performed again, but with the spectral sensitizing dye combined with the aqueous silver salt solution, Solution C, the liquid in the reaction chamber separated into two separate phases, and the experiment was discontinued.

Considering Example 1 and the foregoing comparative investigations together it can be seen that adding the dye to the dispersing medium in the reaction vessel prior to introduction of the halide and silver salts produces a polydispersed emulsion, whereas in the absence of dye, a monodispersed emulsion would be obtained. The speed of the emulsion of Example 1 is higher than that obtained during the comparative investigations. It is somewhat lower than that of the monodispersed emulsion produced by Example 1 of Locker and Daubendiek, cited above. It is significantly higher than that of the polydispersed emulsion produced by Example 2 of Locker and Daubendiek, cited above. The comparisons demonstrate the effectiveness of the invention to produce relatively high speed polydisperse emulsions by double jet precipitation techniques.

The invention has been described with reference to particular preferred embodiments thereof but it will be understood that variations and modifications can be effected within the spirit and scope of the invention.

I claim:

1. In a method of preparing a spectrally sensitized radiation-sensitive silver halide emulsion by a double jet precipitation process in which an aqueous halide salt and an aqueous silver salt are concurrently run into a reaction vessel, the halide salt being at least 50 mole percent chloride, comprising introducing into the reaction vessel an aqueous dispersing medium, introducing into the dispersing medium a minor portion of one of the aqueous halide salt and the aqueous silver salt, and thereafter concurrently introducing into the pAg adjusted dispersing medium in the presence of a peptizer the remainder of the aqueous halide and silver salt solutions, the improvement comprising spectrally sensitizing the silver halide emulsion to be prepared by introducing a methine dye into the reaction vessel in an amount sufficient to provide a monolayer coverage of at least about half of the surface area of the silver halide grains to be formed, assuming uniform surface absorption, prior to concurrent introduction of the aqueous halide and silver salt solutions.

2. The improved method according to claim 1 in which the minor portion is less than 20 percent.

3. The improved method according to claim 2 in which a minor portion of the aqueous halide salt is introduced into the dispersing medium prior to concurrent introduction of the aqueous silver and halide salt solutions.

4. The improved method according to claim 3 in which the peptizer is a gelatin or a gelatin derivative.

5. The improved method according to claim 1 in which the methine dye is a cyanine or merocyanine spectral sensitizing dye.

6. The improved method according to claim 1 in which the halide salt is at least 80 mole percent chloride, based on total halide.

7. The improved method according to claim 1 in which the halide salt is a chloride salt.

8. The improved method according to claim 1 in which a ripening agent is present in the reaction vessel during silver halide emulsion preparation.

9. The improved method according to claim 8 in which the ripening agent is a sulfur containing ripening agent.

10. The improved method according to claim 9 in which the sulfur containing ripening agent is a thioether ripening agent.

11. In a method of preparing a spectrally sensitized radiation-sensitive silver chloride emulsion by a double jet precipitation process in which an aqueous chloride salt and an aqueous silver salt are concurrently run into a reaction vessel comprising introducing into the reaction vessel an aqueous dispersing medium, introducing less than 20 percent of the aqueous chloride salt into the dispersing medium, and thereafter concurrently introducing into the dispersing medium in the presence of a gelatinous peptizer the remainder of the aqueous chloride salt solution and the silver salt solution, the improvement comprising spectrally sensitizing the silver halide emulsion to be prepared by introducing a merocyanine dye into the reaction vessel in an amount sufficient to provide a monolayer coverage of at least about half of the surface area of the silver halide grains to be formed, assuming uniform surface adsorption, prior to concurrent introduction of the aqueous chloride and silver salt solutions and introducing a sulfur containing ripening agent into the reaction vessel during silver halide formation.

12. The improved method according to claim 11 in which the merocyanine dye is a rhodanine merocyanine dye.

13. The improved method according to claim 12 in which the merocyanine dye is 5-(3-ethyl-2-benzothiazolidinylidene)-3-$\beta$-sulfoethylrhodanine.

14. The improved method according to claim 1 in which the methine dye is introduced into the reaction vessel prior to concurrent introduction of the aqueous halide and silver solutions in an amount sufficient to provide from about half to about twice the amount required to provide a monolayer coverage, assuming uniform surface adsorption.

15. The improved method to claim 14 in which the methine dye is introduction into the reaction vessel prior to concurrent introduction of the aqueous halide and silver solutions in an amount in the range of from about 0.01 to 2 grams per mole of silver halide to be formed.

16. The improved method according to claim 15 in which the methine dye is introduced into the reaction vessel prior to concurrent introduction of the aqueous halide and silver solutions in an amount in the range of from about 0.1 to 1 gram per mole of silver halide to be formed.

* * * * *